US006805577B2

(12) United States Patent
Murakami et al.

(10) Patent No.: US 6,805,577 B2
(45) Date of Patent: Oct. 19, 2004

(54) WIRE CONNECTING CONNECTOR

(75) Inventors: Takao Murakami, Shizuoka-ken (JP); Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/986,077

(22) Filed: Nov. 7, 2001

(65) Prior Publication Data

US 2002/0055294 A1 May 9, 2002

(30) Foreign Application Priority Data

Nov. 8, 2000 (JP) ..... P2000-340267

(51) Int. Cl.[7] ..... H01R 11/20
(52) U.S. Cl. ..... 439/405
(58) Field of Search ..... 439/23, 578, 839, 439/579–585, 675, 780, 820, 833, 300–405, 419, 422, 409, 499, 823, 399–404, 418

(56) References Cited

U.S. PATENT DOCUMENTS

| | | | | |
|---|---|---|---|---|
| 4,127,312 A | | 11/1978 | Fleischhacker et al. | |
| 4,351,582 A | * | 9/1982 | Emerson et al. | 439/405 |
| 4,533,200 A | * | 8/1985 | Wilson | 439/395 |
| 4,666,232 A | * | 5/1987 | Shyu | 439/578 |
| 4,688,872 A | | 8/1987 | Pohl | |
| 4,820,179 A | | 4/1989 | Saijo | |
| 5,207,602 A | * | 5/1993 | McMills et al. | 439/836 |
| 5,788,539 A | | 8/1998 | Fedder | |
| 6,123,566 A | * | 9/2000 | Daoud et al. | 439/409 |

FOREIGN PATENT DOCUMENTS

EP 0 736 929 A1 10/1996

OTHER PUBLICATIONS

European Search Report re: EP 01 12 6445 dated Mar. 18, 2002.

* cited by examiner

*Primary Examiner*—J. F. Duverne
(74) *Attorney, Agent, or Firm*—Finnegan, Henderson, Farabow, Garrett, & Dunner, L.L.P.

(57) ABSTRACT

A pair of male terminals (14, 14*a*) is protruded from a tip end of an inserting portion (13*a*) of a male connector (11). A female connector (12) is formed in a tube shape having a bottom capable of being fitted to an inserting portion (13*b*), and a pair of female terminals (15, 15*a*) is provided at the inner side of the bottom part (12*a*). Terminal portions (16) of the female terminals (15, 15*a*) are formed in a fork shape having an opening (18) arranged to oppose the male terminals (14, 14*a*). An acute angle portion (21) which bursts through a coating body (20*a*) of an FFC (20) is provided between the tip end portions of the fork-shape part (19), and a conductive wire connecting portion (22) which grips a conductive wire portion (20*b*) of the FFC (20) that has been burst through by the acute angle portion (21) is provided between the base end portions of the fork-shape part (19), and a terminal receptor (23) to which the male terminals (14, 14*a*) are inserted is provided between the middle portions of the fork-shape part (19).

14 Claims, 7 Drawing Sheets

WIRE CONNECTING CONNECTOR

BACKGROUND OF THE INVENTION

1. Field of the Invention

The present invention relates to a wire connecting connector for connecting an electric wire.

2. Description of the Related Art

An equipment accompanying an electric wire, for example, a fuel injection valve 1 shown in FIG. 1 which electronically controls a fuel injection amount to a combustion chamber of an engine is structured such that a fuel injection amount from a nozzle 1*c* is varied by controlling the degree of opening a needle valve 1*b* based on a control electric current applied to a solenoid coil 1*a*. The fuel injection valve 1 is structured such that a harness for applying a control electric current is connected to the fuel injection valve 1 through a wire connecting connector 2 after the fuel injection valve 1 is mounted to a cylinder head (not shown).

The wire connecting connector 2 comprises a male connector 3 shown in FIG. 2 and a female connector 4 shown in FIG. 3. The male connector 3 is integrally protruded from a head portion of a housing 1*d* that carries the solenoid coil 1*a*. A pin-shaped male terminal 5 protrudes within a tubular receptor 3*a*.

On the other hand, the female connector 4 is structured such that an inserting body 4*b* which is to be fitted to an inner circumference of the receptor 3*a* is provided within a housing 4*a*. The housing 4*a* is fitted to an outer circumference of the receptor 3*a*. A crimped terminal 6 as the female terminal is received within the inserting body 4*b*. A harness for applying the control electric current is connected to this crimped terminal 6.

The connection of the wire connecting connector 2 is performed by inserting the female connector 4 to the male connector 3, whereby the inserting body 4*b* and the receptor 3*a* are fitted to each other and the male terminal 5 is inserted into the crimped terminal 6 to be electrically connected with each other. At this time, the structure is made such that a liquid tight function with respect to an inner circumference of the receptor 3*a* is secured by a packing 8 provided on the outer circumference of the inserting body 4*b*, and a liquid tight function in a receiving portion of the crimped terminal 6 can be secured by a rubber plug 8*a* provided at the introducing portion of the harness 7. A disengagement prevention can be achieved by engaging an engaging projection 3*b* protruded from a tip end portion of the receptor 3*a* with a recess portion 4*c* of the housing 4*a*.

An elastic contact piece 6*a* is provided within the crimped terminal 6 so as to securely perform an electric connection between the terminals, and the male terminal 5 is structured such that it is inserted into the crimped terminal 6 by compressing the elastic contact piece 6*a*.

However, in the wire connecting connector 2 mentioned above, the crimped terminal 6 to which the male terminal 5 is inserted is provided with a receiving portion A formed in a rectangular column shape so as to receive the elastic contact piece 6*a*, a harness fixing portion B for fixing the end portion of the harness 7 from which a coating material has been peeled of f, and an engaging shoulder 9 with which a lance C protruded from the housing 4*a* is engaged, and the like, which makes the construction of the terminal complex and leads to high production costs.

SUMMARY OF THE INVENTION

In view of the above consideration, an object of the present invention is to provide a wire connecting connector which can simplify a terminal structure so as to reduce a cost by forming a female terminal in a fork shape and gripping a harness and an opposing male terminal in the fork-shape part.

In order to achieve the object mentioned above, according to the first aspect of the present invention, there is provided a wire connecting connector comprising a first connecting body from which a male terminal is protruded, and a second connecting body which is fitted to the first connecting body and from which a female terminal to which the male terminal is inserted is protruded, wherein the female terminal is formed in a fork shape having an opening arranged to oppose the male terminal, wherein an acute angle portion which bursts through a coating body of a harness is provided between the tip portions of the fork part, and a conductive wire connecting portion which grips a conductive wire portion of the harness that has been burst through by the acute angle portion is provided between the base end portions of the fork part, and a terminal receptor to which the male terminal is inserted is provided between the middle portions of the fork part.

In this wire connecting connector, since the female terminal is formed in a fork shape and the acute angle portion, the conductive wire connecting portion, and the terminal receptor are respectively provided between the tip end, base end, and middle portions of the fork shape part, it can be connected to the harness by first bursting through the coating body of the harness with the acute angle portion and guiding the conductive wire portion to the conductive wire connecting portion so that it is held there. The connection of the wire connecting connector is completed by mutually fitting the first connecting body to the second connecting body in this state and inserting the male terminal to the terminal receptor. While it is necessary that the female terminal be provided with the acute angle portion, the conductive wire connecting portion, and the terminal receiving portion, it is sufficient to form them in the opposing side of the fork part, and therefore, the structure can be simplified.

According to another aspect of the present invention, there is provided a wire connecting connector as recited in the first aspect, wherein a disengagement prevention means for holding a fitted state of the first connecting body and the second connecting body is provided between the first connecting body and the second connecting body.

Since the disengagement prevention means for holding the fitted state between the first connecting body and the second connecting body is provided, the electrical engagement state between the male terminal and the female terminal can be stably maintained by the disengagement prevention means.

According to still another aspect of the present invention, there is provided a wire connecting connector according to the second aspect, wherein the disengagement prevention means also serves as a positioning means which determines a relative rotational position between the first connecting body and the second connecting body.

According to this wire connecting connector, since the structure is made such that the disengagement prevention means also serves as the positioning means for determining the relative rotational position between the first connecting body and the second connecting body by setting a disengagement prevention position at which the male terminal and the female terminal oppose to each other when fitting the first connecting body to the second connecting body. The male terminal and the female terminal come to oppose with each other by their relative rotation toward the disengagement prevention position of the disengagement prevention means. The male terminal is securely inserted to the female terminal by relatively pressing the first connecting body and the second connecting body to each other in this state. Since the disengagement prevention means is also used as the positioning means, the structure of the wire connecting connector can be simplified.

DESCRIPTION OF THE PREFERRED EMBODIMENT

An embodiment of the present invention will be described in detail below with reference to the accompanying drawings.

Figure 1:
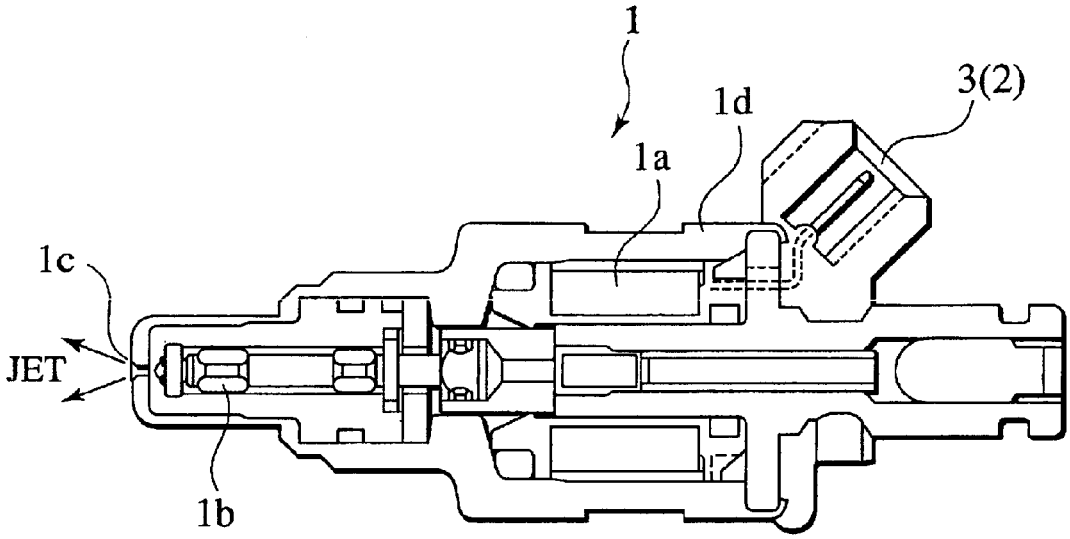
FIG. 1 is a cross sectional view of a fuel injection valve showing an arrangement of a proposed wire connecting connector.
Figure 2:
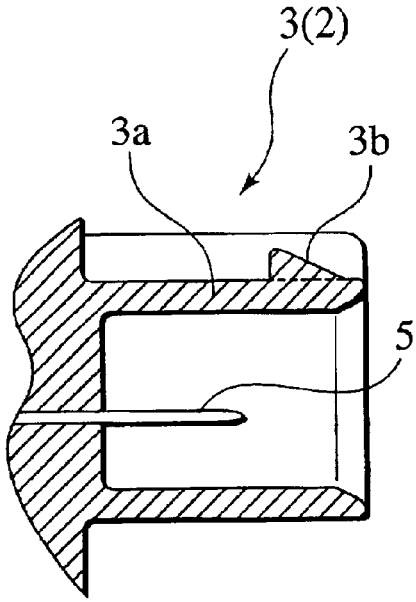
FIG. 2 is a cross sectional view showing a male connector of the proposed wire connecting connector.
Figure 3:
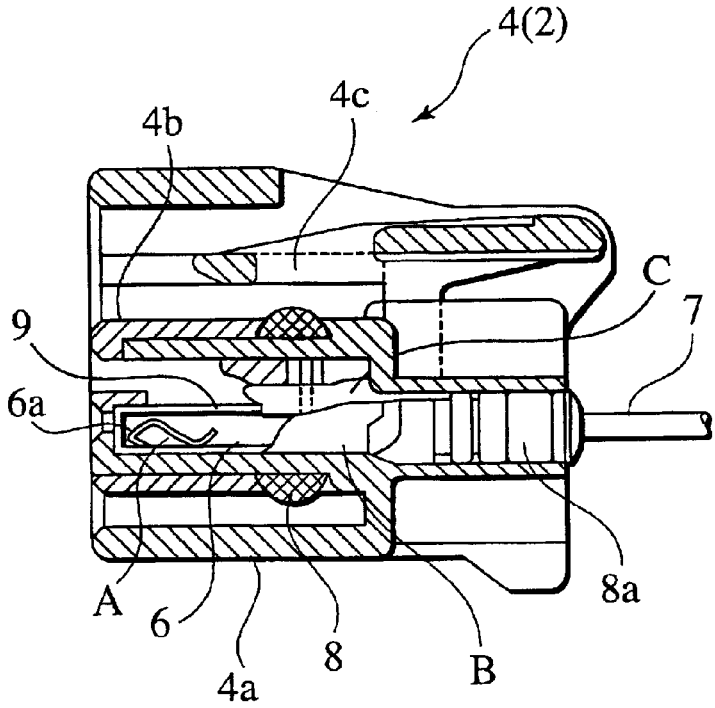
FIG. 3 is a cross sectional view showing a female connector of the proposed wire connecting connector.
Figure 4:
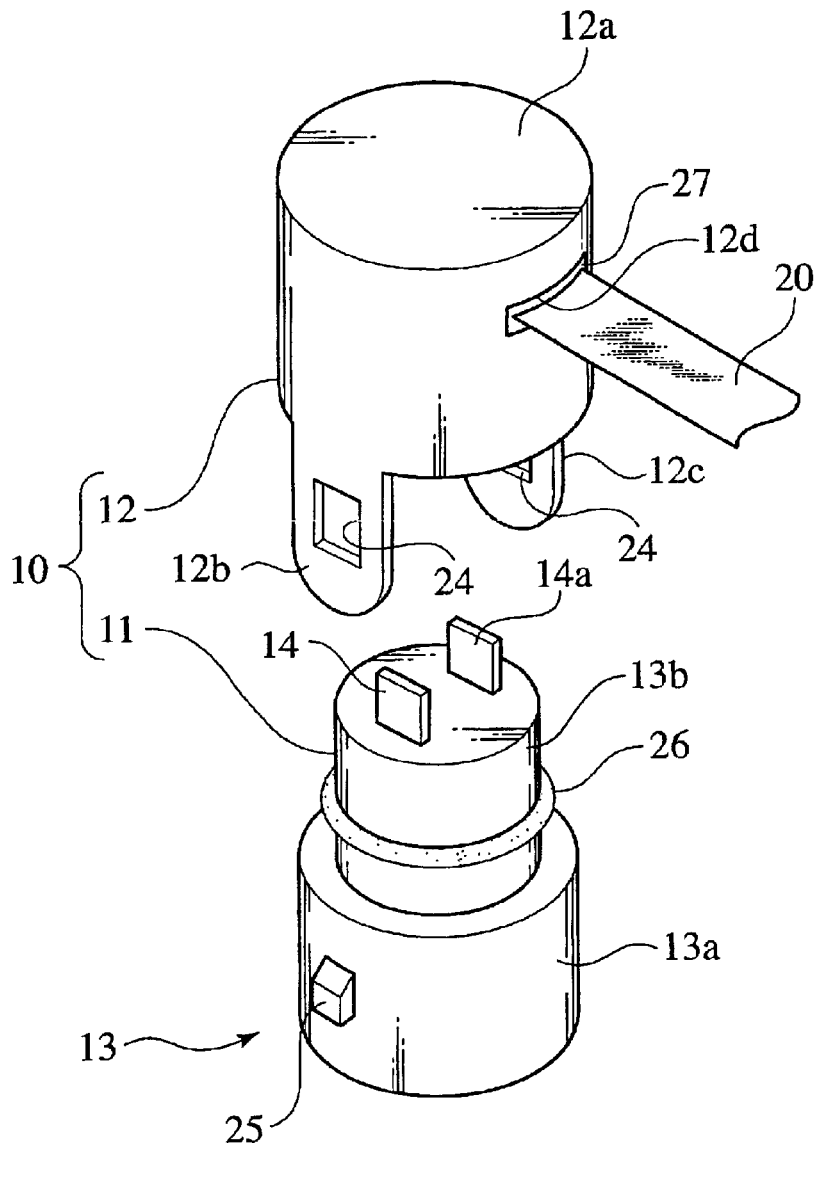
FIG. 4 is a perspective view of a state in which a first connecting body and a second connecting body are separated, showing one embodiment of a wire connecting connector according to the present invention.
Figure 5:
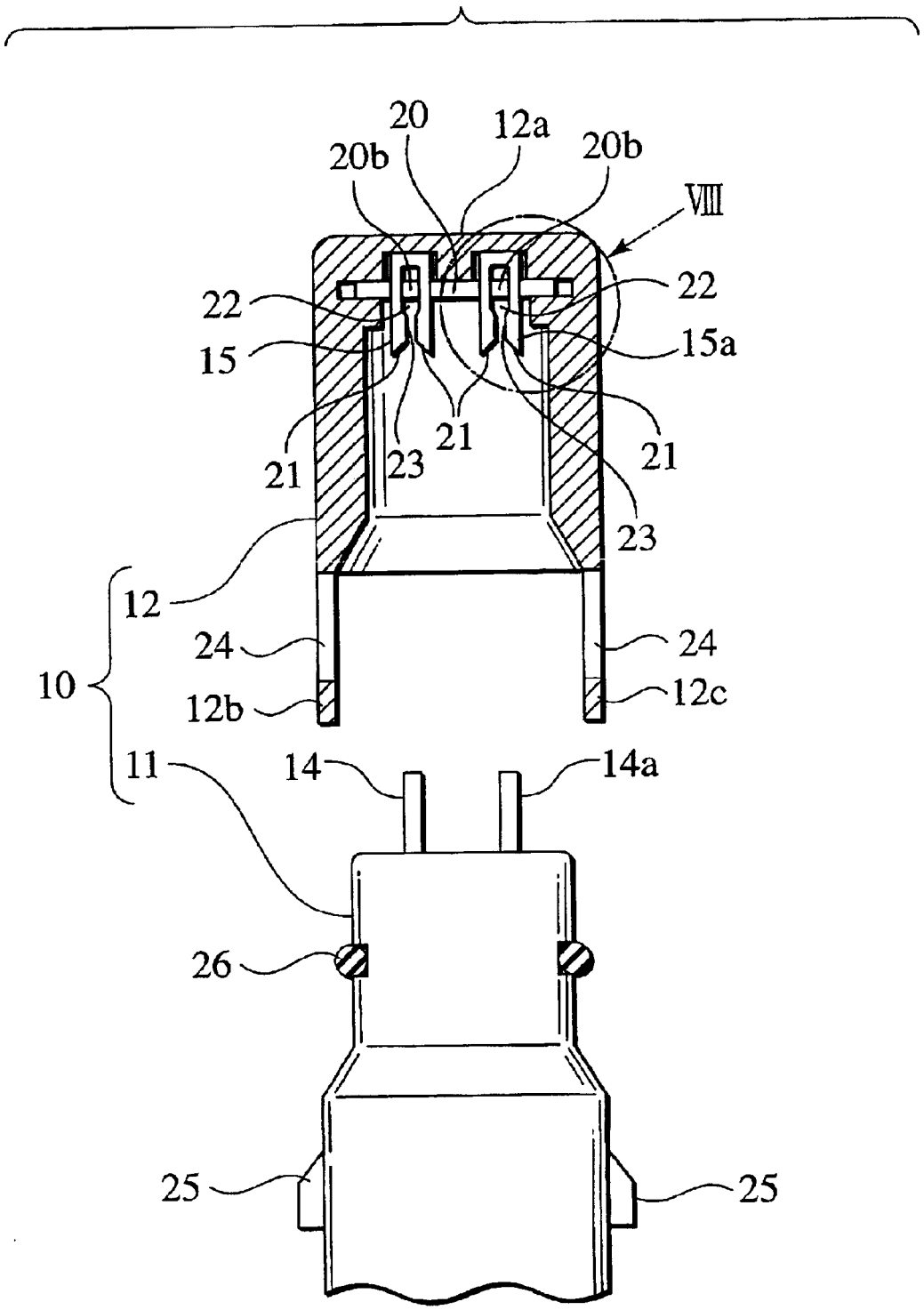
FIG. 5 is a cross-sectional front view of the state in which the first connecting body and the second connecting body are separated, showing one embodiment of the wire connecting connector according to the present invention.
Figure 6:
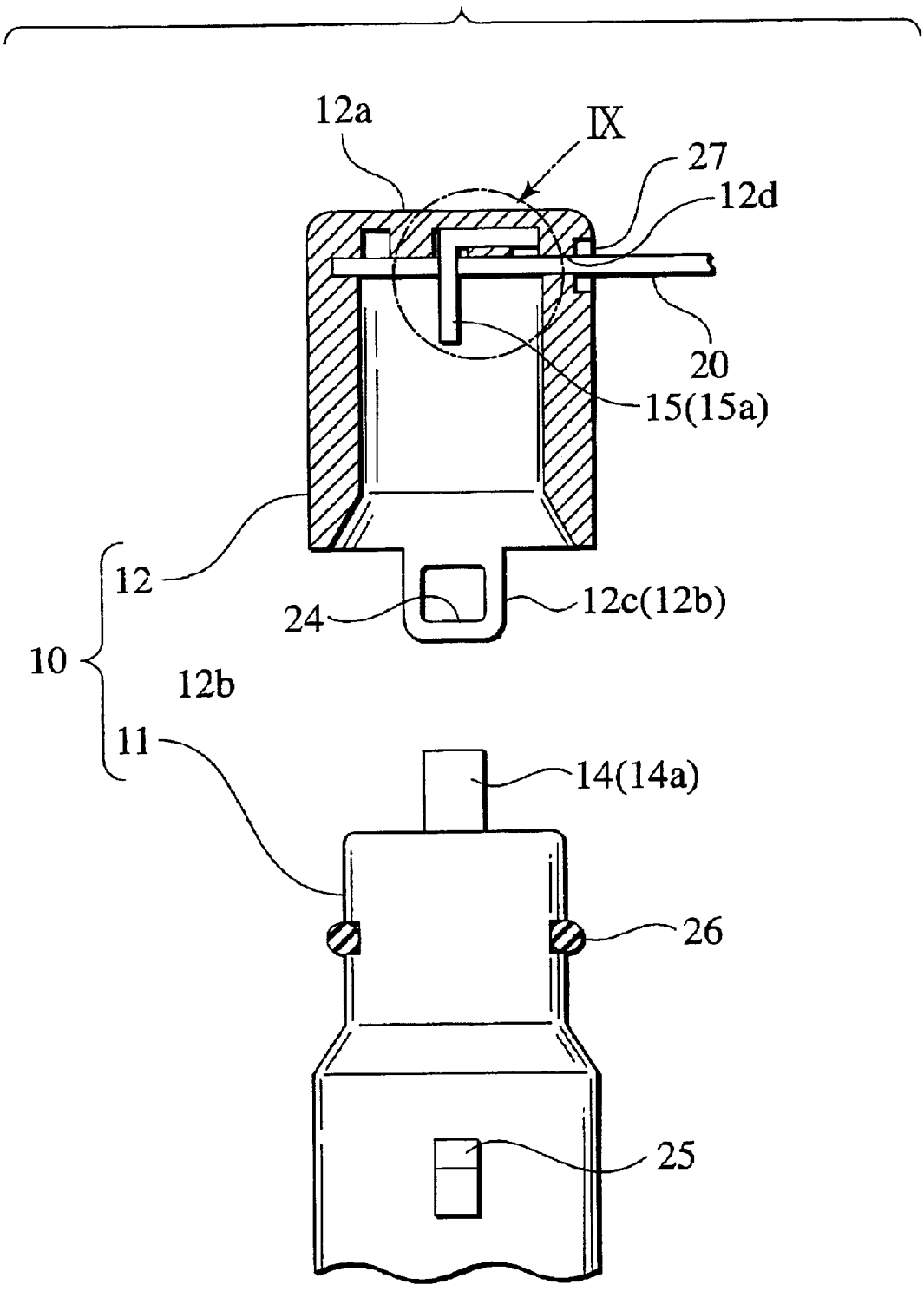
FIG. 6 is a cross-sectional side view of the state in which the first connecting body and the second connecting body are separated, showing one embodiment of the wire connecting connector according to the present invention.

A wire connecting connector 10 according to the present embodiment has a male connector 11 as a first connecting body and a female connector 12 as a second connecting body as shown in FIG. 4. The male connector 11 is formed at a top portion of an equipment 13 such as a fuel injection valve or the like. As shown in FIGS. 5 and 6, an inserting portion 13*b* having a reduced diameter is formed from a general portion 13*a* of the equipment 13, and a pair of male terminals 14 and 14*a* are protruded from a tip end of the inserting portion 13*b*. The male terminals 14 and 14*a* are formed in a flat plate shape arranged in a "geta" or wooden clogs support form at a predetermined interval. Furthermore, end portions of the male terminals 14 and 14*a* to be inserted within the inserting portion 13*b* are connected to an electric operating part of the equipment 13.

Figure 7:
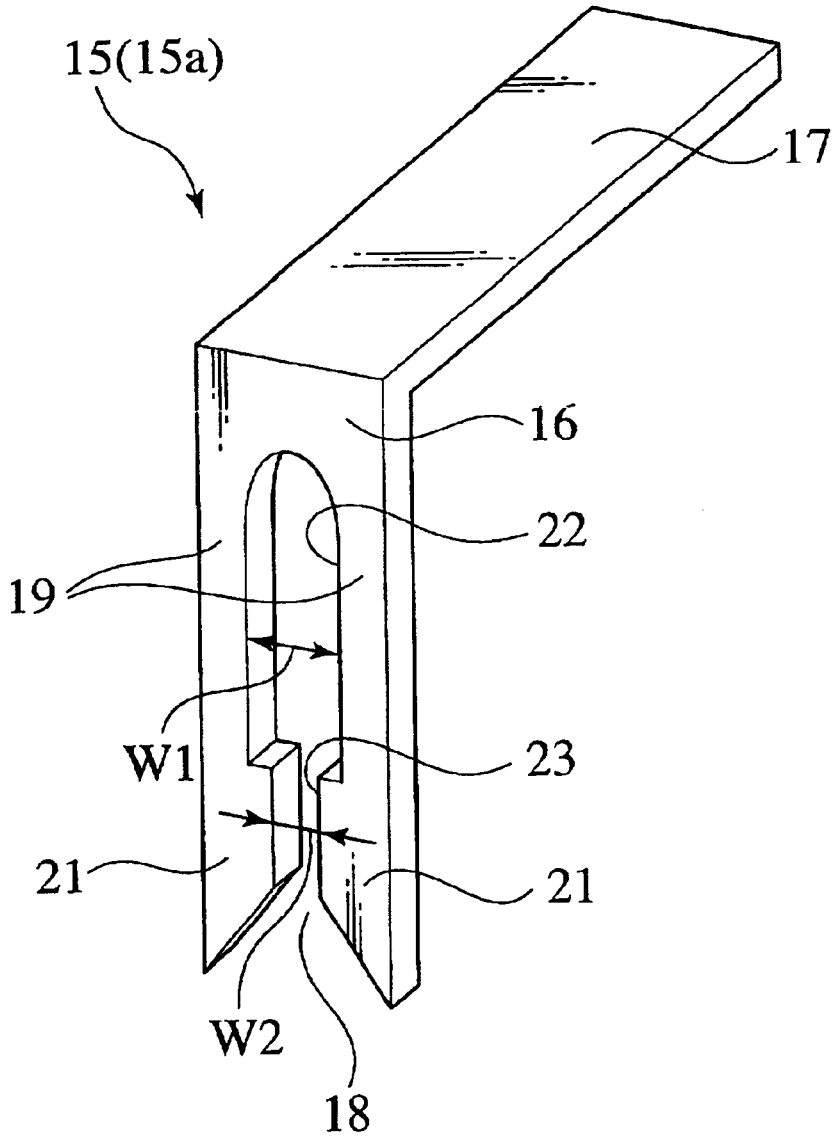
FIG. 7 is an enlarged perspective view of a female terminal, showing one embodiment of the wire connecting connector according to the present invention.

The female connector 12 is open to the male connector 11 side and is formed in a tube shape having a bottom which is capable of fitting to the inserting portion 13*b*, and a pair of female terminals 15 and 15*a* are provided in the inner side of the bottom portion 12*a*. Each of these female terminals 15 and 15*a* is structured by bending a strip-like flat plate in an L shape to form a terminal portion 16 at one side of the bent part and a supporting portion 17 at the other side of the bent part, as shown in FIG. 7. The supporting portion 17 is inserted in the bottom portion 12*a* of the female connector 12 to be parallel thereto and is fixed, and the terminal portion 16 is vertically protruded from the bottom portion 12*a*.

Figure 8:
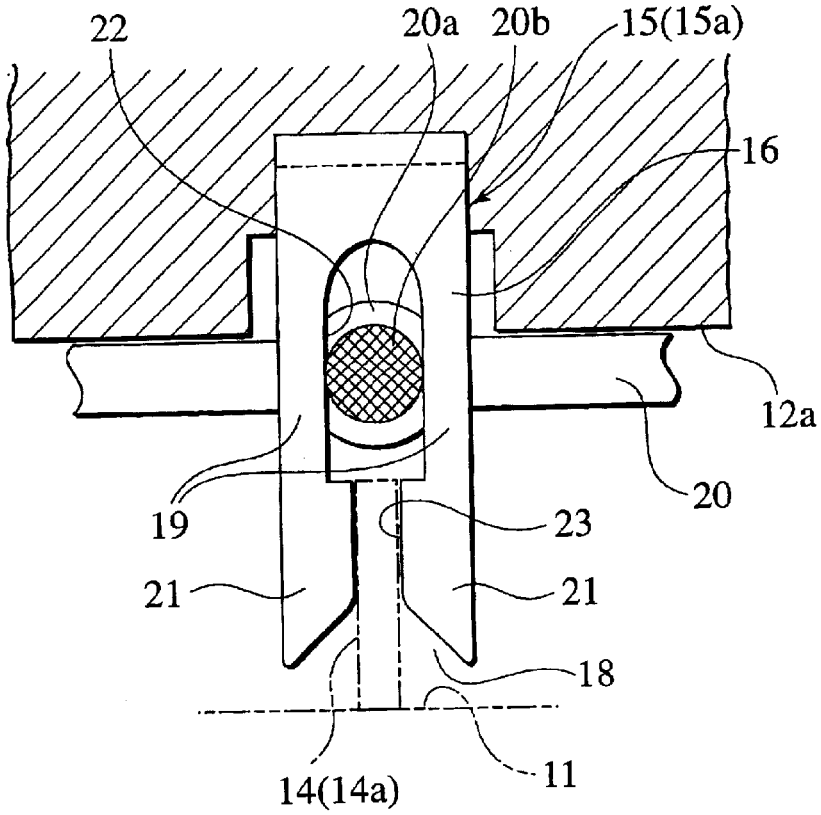
FIG. 8 is an enlarged cross sectional view of a portion X in FIG. 5, showing one embodiment of the wire connecting connector according to the present invention.
Figure 9:
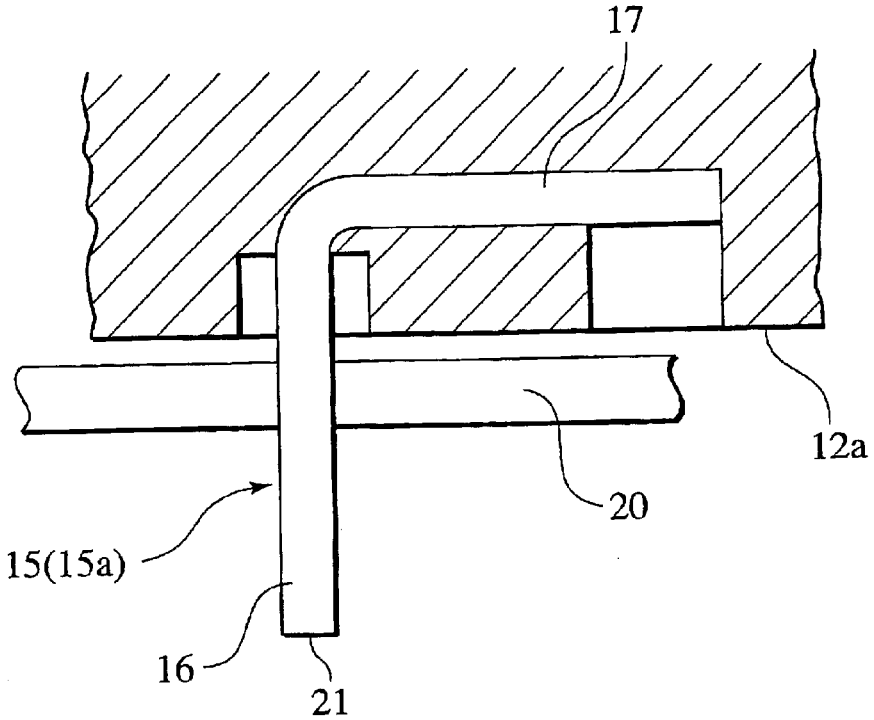
FIG. 9 is an enlarged cross sectional view of a portion Y in FIG. 6, showing one embodiment of the wire connecting connector according to the present invention.

The terminal portion 16 is provided with an opening 18 formed in a fork shape at the lower end side of the drawing to oppose to each of the male terminals 14 and 14*a*. An acute angle portion 21 which bursts through or tears a coating body 20*a* of a flexible flat cable (FFC) 20 as a harness (see FIG. 8) is provided at the tip end portions of a fork-shape part 19. Furthermore, a conductive wire connecting portion 22 which grips a conductive wire portion 20*b* of the FFC 20 that has been burst through or torn by the acute angle portions 21 is provided between the base end portions (at the supporting portion 17 side) of the fork-shape part 19. A terminal receptor 23 to which each of the terminals 14 and 14*a* is inserted is provided between the middle portions of the fork-shape part 19.

The acute angle portion 21 is inclined so that opposing inner side of the fork-shape portion 19 forms a tapered shape, and each of the tip end portions is formed with an acute angle. A gripping width W1 of the conductive wire connecting portion 22 is determined corresponding to a diameter of the conductive wire 20*b*, and the conductive wire connecting portion 22 is formed to be slightly narrower than the diameter of the conductive wire 20*b*. The conductive wire 20*b* is guided to the conductive wire connecting portion 22 and is held after the coating portion 20*a* of the connecting end of the FFC 20 is burst through by the acute angle portion 21. The FFC 20 connected to the conductive wire connecting portion 22 is taken out from an opening 12*d* formed on a side of the female connector 12 and is connected to an electric power source (not shown). The inserting width W2 of the terminal receptor 23 is determined corresponding to a thickness of the male terminals 14 and 14*a*, and the terminal receptor 23 is formed to be slightly narrower than the thickness of the male terminals 14 and 14*a*.

The main part of the wire connecting connector 10 according to the present embodiment is structured in the manner mentioned above. In the present embodiment, a pair of extended portions 12*b* and 12*c* to be fitted to the general portion 13*a* of the male connector 11 are further provided at the opposing sides of the opening of the female connector 12 mentioned above, as shown in FIGS. 4 and 5. Engagement holes 24 are formed at the extended portions 12*b* and 12*c*. On the other hand, a pair of engagement projections 25 is protruded from the corresponding part of the general portion 13*a* of the male connector 11, thereby constituting a disengagement prevention means.

Furthermore, the disengagement prevention means is structured such that a relative rotational position between the male connector 11 and the female connector 12 is set to a rotational position at which the respective corresponding male terminals 14 and 14*a* and female terminals 15 and 15*a* oppose to each other. This can be made by coinciding a width in the circumferential directions of the engagement holes 24 and of the engagement projections 25. As such, in the present embodiment, the disengagement prevention means is structured to also serve as a positioning means.

At the fitted inner portion between the male connector 11 and the female connector 12, a water proof function is applied by sealing between an outer circumference of the inserting portion 13*b* and an inner circumference of the female connector 12 through an O-ring 26 and by sealing an opening portion 12*d* for taking out the FFC 20 with a sealing member 27 such as a thermoplastic resin or the like.

According to the structure mentioned above, the wire connecting connector 10 of the present embodiment is structured such that the female terminals 15 and 15*a* are formed in the fork shape having the acute angle portion 21 between the tip end portions, the conductive wire connecting portion 22 between the base end portions, and the terminal receptor 23 between the middle portions. In order to connect the FFC to the female terminals 15 and 15*a*, it is sufficient to burst through the coating body 20*a* of the FFC 20 with the acute angle portion 21 and guide it to the conductive wire connecting portion 22 so as to grip it. In order to connect the wire connecting connector 10 after connecting the FFC 20 in the manner mentioned above, it is sufficient to fit the male connector 11 and the female connector 12 to each other and insert the male terminals 14 and 14*a* at one side into the terminal receptors 23 of the female terminals 15 and 15*a* at the other side.

While it is necessary that each of the female terminals 15 and 15*a* is still provided with the acute angle portion 21, the conductive wire connecting portion 22, and the terminal receptor 23, it is sufficient to form them in the opposing side of a fork-shaped part, and therefore, the structure can be simplified. Since the female terminals 15 and 15*a* can be formed in a single process such as punching a flat plate or the like, it is possible to largely reduce production costs.

Furthermore, according to the present embodiment, since the disengagement prevention means that comprises the engaging hole 24 and the engaging projection 25 is provided between the male connector 11 and the female connector 12, an electrical connection between the female connectors 15 and 15*a* and the male connectors 14 and 14*a* inserted to their terminal receptors 23 can be stably maintained.

According to the present embodiment, since the engagement position of the disengagement prevention means also serves as the positioning means for determining the relative rotational position between the male connector 11 and female connector 12, the male terminals 14 and 14*a* and the female terminals 15 and 15*a* oppose to each other by relatively rotating the male connector 11 and the female connector 12 to the engagement position of the disengagement prevention means. The male terminals 14 and 14*a* and the female terminals 15 and 15*a* are securely inserted to each other by relatively pressing the male connector 11 and the female connector 12 to each other, and therefore, connection error can be avoided. In this case, since the disengagement prevention means also serves as the positioning means, it is not necessary to provide them as independent structures, and the structure of the wire connector 10 can be simplified accordingly.

What is claimed is:

1. A wire connecting connector comprising:

a first connecting body having a protruding male terminal;

a second connecting body fitted to the first connecting body, the second connecting body having a protruding female terminal configured to receive the protruding male terminal, the protruding female terminal having a fork shaped portion with a tip end and a base end;

an acute angle portion on the tip end, the acute angle portion configured to burst through a coating body of a harness;

a conducting wire connecting portion on the base end, the conducting wire connecting portion configured to grip a conductive wire; and a terminal receptor between the tip end and the base end, the terminal receptor configured to grip the protruding male terminal.

2. A wire connecting connector according to claim 1, further comprising a disengagement prevention means for holding together the first connecting body and the second connecting body.

3. A wire connecting connector according to claim 2, wherein the disengagement prevention means also serves as a positioning means for determining a relative rotational position between the first connecting body and the second connecting body.

4. A wire connecting connector according to claim 2, wherein the disengagement prevention means comprises an engagement hole and an engagement projection.

5. A wire connecting connector comprising:

a first connecting body having a protruding male terminal;

a second connecting body fitted to the first connecting body, the second connecting body having a protruding female terminal configured to receive the protruding male terminal, the protruding female terminal having a fork shaped portion with a tip end and a base end;

an acute angle portion on the tip end, the acute angle portion configured to burst through a coating body of a harness;

a conducting wire connecting portion on the base end, the conducting wire connecting portion configured to grip a conductive wire; and a terminal receptor between the tip end and the base end, the terminal receptor configured to receive the protruding male terminal, wherein the protruding male terminal and the protruding female terminal are configured to conduct electricity.

6. A wire connecting connector according to claim 5, further comprising a disengagement prevention means for holding together the first connecting body and the second connecting body.

7. A wire connecting connector according to claim 6, wherein the disengagement prevention means also serves as a positioning means for determining a relative rotational position between the first connecting body and the second connecting body.

8. A wire connecting connector according to claim 6, wherein the disengagement prevention means comprises an engagement hole and an engagement projection.

9. A wire connecting connector according to claim 5, wherein an electrical connection is established between the protruding male terminal and the conductive wire via the protruding female terminal.

10. A wire connecting connector comprising:

a first connecting body having a protruding male terminal;

a second connecting body fitted to the first connecting body, the second connecting body having a protruding female terminal configured to receive the protruding male terminal, the protruding female terminal having a fork shaped portion with prongs each having a tip end and a base end;

an acute angle portion on each tip end, the acute angle portion configured to burst through a coating body of a harness;

a conducting wire connecting portion disposed between the prongs, the conducting wire connecting portion configured to grip a conductive wire; and a terminal receptor disposed between the prongs, the terminal receptor configured such that the distance between the prongs at the terminal receptor is narrower than a thickness of the protruding male terminal, wherein the protruding male terminal and the protruding female terminal are configured to conduct electricity.

11. A wire connecting connector according to claim 10, further comprising a disengagement prevention means for holding together the first connecting body and the second connecting body.

12. A wire connecting connector according to claim 11, wherein the disengagement prevention means also serves as a positioning means for determining a relative rotational position between the first connecting body and the second connecting body.

13. A wire connecting connector according to claim 11, wherein the disengagement prevention means comprises an engagement hole and an engagement projection.

14. A wire connecting connector according to claim 11, wherein the conducting wire connecting portion is configured such that the distance between the prongs at the conducting wire connecting portion is wider than the distance between the prongs at the terminal receptor.

* * * * *